US009207031B2

(12) United States Patent
Balthaser et al.

(10) Patent No.: US 9,207,031 B2
(45) Date of Patent: Dec. 8, 2015

(54) WEAPON WITH THERMAL MANAGEMENT COMPONENTS

(71) Applicant: Tyco Electronics Corporation, Berwyn, PA (US)

(72) Inventors: Andrew Dewitt Balthaser, Dauphin, PA (US); Robert Neil Mulfinger, York Haven, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/591,532

(22) Filed: Jan. 7, 2015

(65) Prior Publication Data

US 2015/0300764 A1 Oct. 22, 2015

Related U.S. Application Data

(62) Division of application No. 13/494,140, filed on Jun. 12, 2012.

(51) Int. Cl.

| | |
|---|---|
| ***F41A 13/00*** | (2006.01) |
| ***F41A 13/12*** | (2006.01) |
| *F41A 21/24* | (2006.01) |

(52) U.S. Cl.
CPC *F41A 13/12* (2013.01); *F41A 21/24* (2013.01)

(58) Field of Classification Search
USPC ..... 89/14.1, 16; 42/76.01; 165/183
See application file for complete search history.

(56) References Cited

U.S. PATENT DOCUMENTS

| | | | | |
|---|---|---|---|---|
| 4,753,154 | A * | 6/1988 | Higashi | 89/14.1 |
| 4,841,836 | A * | 6/1989 | Bundy | 89/14.1 |
| 5,062,346 | A * | 11/1991 | Greve Hansen et al. | 89/14.1 |
| 5,837,921 | A * | 11/1998 | Rinaldi et al. | 89/14.1 |
| 7,464,496 | B1 * | 12/2008 | Davies et al. | 42/75.02 |
| 2014/0076135 | A1 * | 3/2014 | Balthaser et al. | 89/14.1 |

* cited by examiner

*Primary Examiner* — J. Woodrow Eldred

(57) ABSTRACT

A weapon includes a cover system that extends a length. The cover system includes an opening that extends through the length of the cover system. The weapon includes a barrel that extends through the opening of the cover system. The cover system includes a composite material that is configured to provide thermal insulation relative to heat emitted from the barrel.

8 Claims, 6 Drawing Sheets

WEAPON WITH THERMAL MANAGEMENT COMPONENTS

CROSS-REFERENCE TO RELATED APPLICATIONS

The present application is a divisional application of U.S. application Ser. No. 13/494,140, filed Jun. 12, 2012, the entire disclosure of which is incorporated by reference herein.

BACKGROUND OF THE INVENTION

The subject matter herein relates generally to weapons.

Some known weapons (e.g., AR-15s, M4's, M16's, other firearms, artillery pieces, etc.) heat up during use and/or exposure to the sun. The weapon may become so hot that the user has to wear gloves to protect the user from being burned when handling the weapon. In some situations, for example when the weapon is used for extended firing during a firelight, the heat from numerous fired rounds may build up to the point that the accuracy and/or operation of the weapon may be deteriorated. Moreover, the chamber of the weapon may become so hot that a chambered round may fire, or "cook-off", without the trigger of the weapon being engaged.

BRIEF DESCRIPTION OF THE INVENTION

In one embodiment, a weapon includes a cover system that extends a length. The cover system includes an opening that extends through the length of the cover system. The weapon includes a barrel that extends through the opening of the cover system. The cover system includes a composite material that is configured to provide thermal insulation relative to heat emitted from the barrel.

In another embodiment, a weapon includes a cover system extending a length to an end of the cover system. The weapon includes a barrel having an exposed segment that extends outwardly from the end of the cover system and is exposed to ambient air. A heat sink is mounted to the exposed segment of the barrel. The heat sink is configured to dissipate heat from the barrel to the ambient air. A heat pipe is mounted to the barrel such that the heat pipe thermally communicates with the heat sink. The heat pipe is configured to direct heat to the heat sink from a location along the barrel that is spaced apart from the heat sink.

In another embodiment, a cover system is provided for a weapon that includes a barrel. The cover system includes a base extending a length. The base includes an opening that extends through the length of the base. The base is configured to be mounted to the weapon such that the barrel extends through the opening of the base. At least one rail extends from the base. At least one of the base or the at least one rail includes a composite material that is configured to provide thermal insulation relative to heat emitted from the barrel.

DETAILED DESCRIPTION OF THE INVENTION

Figure 1:
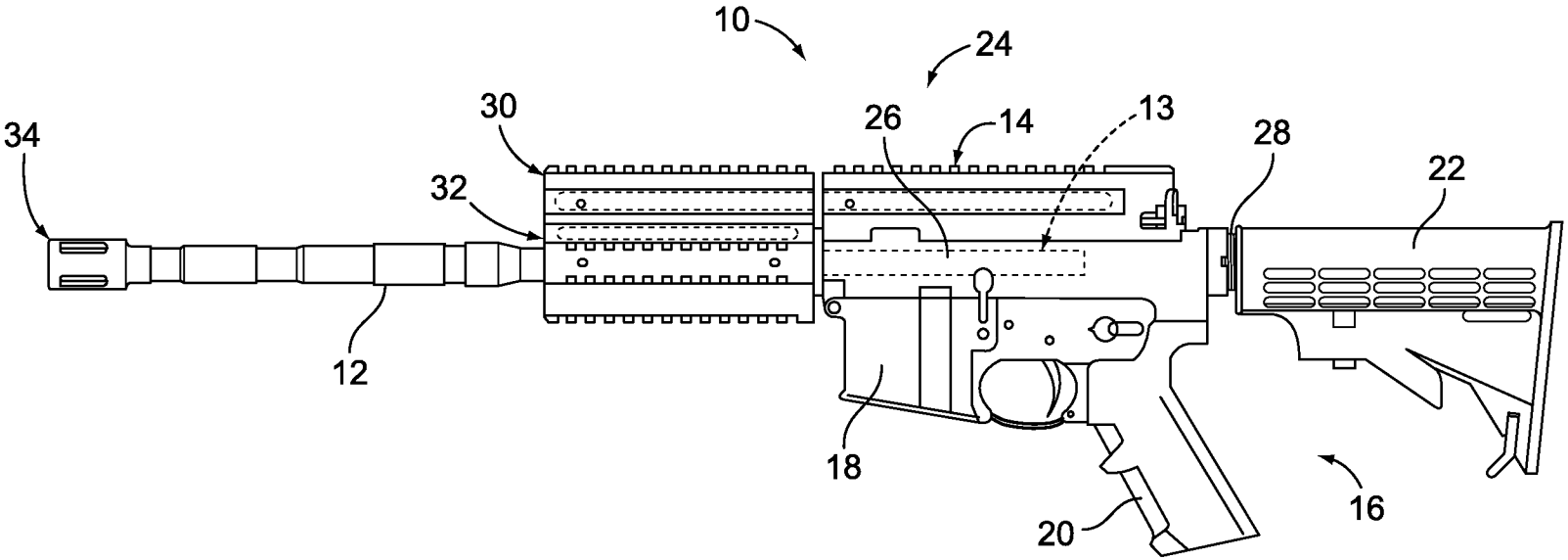
FIG. 1 is a side elevational view of an exemplary embodiment of a weapon.

FIG. 1 is a side elevational view of an exemplary embodiment of a weapon 10. In the exemplary embodiment, the weapon 100 is an AR-15 or M-16 style weapon, however, the weapon 10 is not limited to AR-15 style weapons. For example, the weapon 10 is not limited to firearms that can be carried by a person. Rather, the weapon 10 may be any type of weapon that generates heat during use. Other examples of the weapon 10 include, but are not limited to, artillery pieces, cannon, relatively large machine guns or other guns that cannot be carried by a person, and/or the like.

In the exemplary embodiment, the weapon 10 is of a type that includes a barrel 12 and a cover system 14. The weapon 10 includes a chamber 13 wherein a projectile is inserted prior to being fired. In the exemplary embodiment, the chamber 13 defines a segment of the barrel 12. But, the chamber 13 may be separate from the barrel 12 in alternative embodiments, for example similar to a revolver wherein the chamber is a portion of a firing cylinder. The weapon 10 may include a lower part 16 that includes a lower receiver 18, a hand grip 20, and a butt stock 22. The hand grip 20 and butt stock 22 each extend from the lower receiver 18 of the lower part 16. The lower part 16 may include other components of the weapon 10. The lower part 16 may sometimes be referred to as a "base". The cover system 14 may sometimes be referred to as a "forward cover system" or a "hand guard".

The weapon 10 may include an upper part 24 that is coupled to the lower part 16. The upper part 24 includes the barrel 12, an upper receiver 26, and the cover system 14. The upper part 24 may include other components of the weapon 10. The barrel 12 is provided at one end of the weapon 10 and the butt stock 22 is provided at the opposite end of the weapon 10. The upper receiver 26 of the upper part 24 and the lower receiver 18 of the lower part 16 may be removably coupled to one another. In the exemplary embodiment, the lower receiver 18 includes a buffer tube 28 extending rearward therefrom. The butt stock 22 is coupled to, and extends from, the buffer tube 28 of the lower receiver 18. The hand grip 20 extends from the lower receiver 18.

The cover system 14 extends from the upper receiver 26. Specifically, the cover system 14 extends a length outwardly from the upper receiver 26 to an end 30 of the cover system 14. The cover system 14 includes an opening 32 that extends through the length of the cover system 14. The barrel 12 is held by the upper receiver 26 such that the barrel 12 extends a length outwardly from the upper receiver 26 to an end 34 of the barrel 12. The barrel 12 extends from the upper receiver 26, through the opening 32 of the cover system 14, and outwardly from the end 30 of the cover system 14 to the end 34.

One or more components (not shown) may be mounted to the cover system 14. For example, the weapon 10 may include, but is not limited to including, a laser, a light (e.g., a flashlight), a sight, a range finder, night vision scope, a telescopic scope, a camera (e.g., a video camera, a night vision camera, and/or a still camera), a microphone, a speaker, and/or the like that is mounted to the cover system 14. Optionally, the upper receiver 26 is movable relative to the lower receiver 18 between a closed position (shown in FIG. 1) and an open position (not shown). In the open position, internal components of the weapon 10 may be accessed, such as, but not limited to, for removing a cartridge, casing, and/or projectile jammed in the weapon 10, and/or for cleaning the barrel 12.

Figure 2:
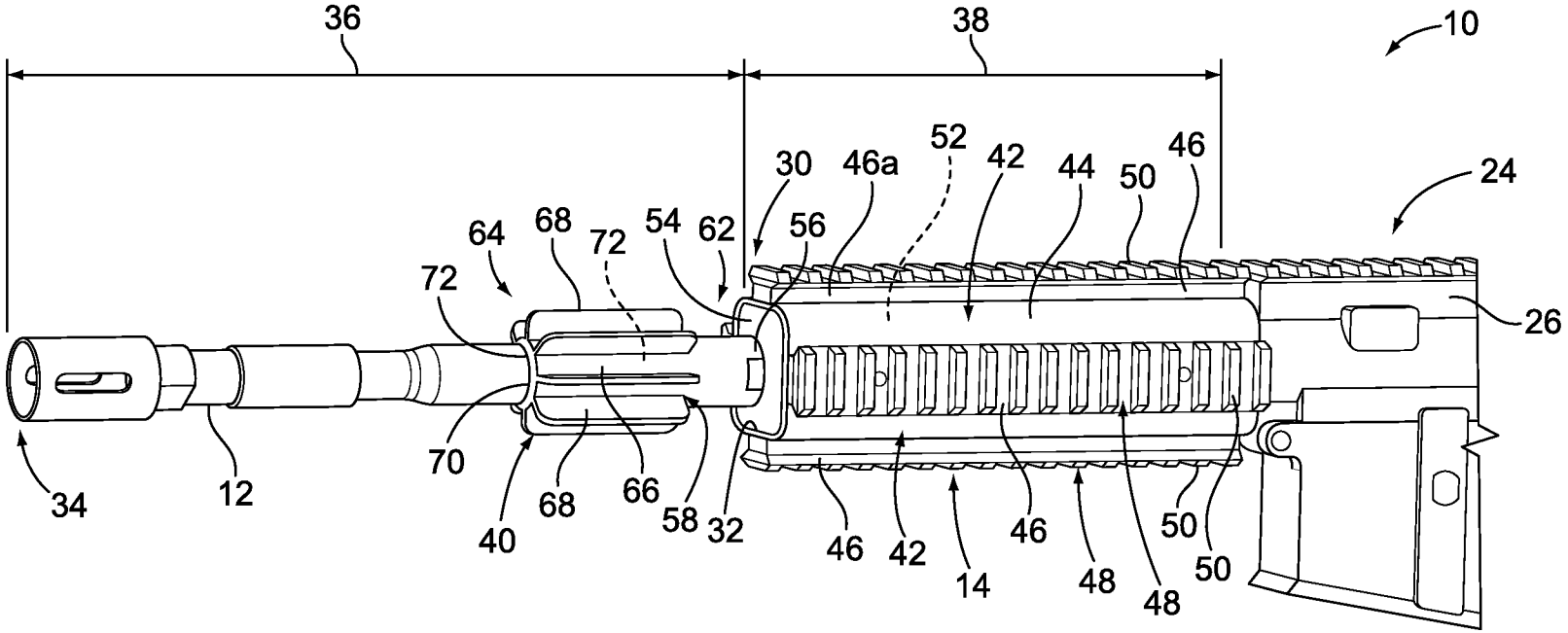
FIG. 2 is a perspective view of a portion of the weapon shown in FIG. 1.

FIG. 2 is a perspective view of a portion of the weapon 10. As described above, the length of the barrel 12 extends from the upper receiver 26, through the opening 32 of the cover system 14, and outwardly from the end 30 of the cover system 14 to the end 34 of the barrel 12. The length of the barrel 12 includes an exposed segment 36 and a covered segment 38. The exposed segment 36 extends outwardly from the end 30 of the cover system 14 and includes the end 34 of the barrel 12. At least a portion of the length of the exposed segment 36 is exposed to ambient air. In the exemplary embodiment, a portion of the length of the exposed segment 36 is covered by an optional heat sink 40 (described below with reference to FIGS. 2-4) that is mounted to the exposed segment 36, such that only a portion of the length of the exposed segment 36 is exposed to ambient air. Alternatively, an approximate entirety of the length of the exposed segment 36 is exposed to ambient air. Moreover, other components (not shown; such as, but not limited to, a sight and/or the like) of the weapon 10 may be mounted to the exposed segment 36 in a manner that covers at least a portion of the length of the exposed segment 36. Any amount of the length of the exposed segment 36 may be exposed to ambient air.

The covered segment 38 of the barrel 12 extends between the exposed segment 36 and the upper receiver 26. The covered segment 38 extends within the opening 32 of the cover system 14 and is at least partially surrounded by the cover system 14. In the exemplary embodiment, the cover system 14 surrounds an approximate entirety of the exterior circumference of the covered segment 38 along an approximate entirety of the length of the covered segment 38. But, the cover system 14 may alternatively surround only a portion of the exterior circumference of the covered segment 38 along an approximate entirety or only a portion of the length of the covered segment 38. For example, the cover system 14 may not form a continuous ring around the exterior circumference of the covered segment 38 and/or the cover system 14 may include one or more slots (not shown, e.g., within a base 44 of the cover system 14) that exposes a portion of the exterior circumference of the covered segment 38.

Optionally, the cover system 14 includes a composite material 42 that is configured to provide thermal insulation relative to heat emitted from the barrel 12, as will be described below. The cover system 14 includes a base 44 and one or more rails 46 that extend from the base 44. In the exemplary embodiment, the cover system 14 includes four rails 46, but the cover system 14 may include any number of the rails 46. As described above, one or more components (not shown) may be mounted on the cover system 14. Specifically, one or more components may be mounted to one or more of the rails 46. For example, one or more components may be mounted to an upper rail 46*a* of the rails 46. One or more of the rails 46 may include a textured surface 48 or other structure to, for example, facilitate mounting one or more components to the rails 46 and/or provide a non-slippery gripping surface. In the exemplary embodiment, the textured surface 48 of the rails 46 is provided by a plurality of teeth 50 that extend outwardly on the rails 46. Other textures and structures may be provided in addition or alternative to the teeth 50. The teeth 50 are sometimes referred to as "recoil grooves".

The cover system 14 may function as a hand guard. Specifically, the cover system 14 may provide a location on the weapon 10 for a user to grasp and/or support the weapon 10 with the user's hand and/or arm. In some alternative embodiments, the cover system 14 does not include the rails 46, but rather merely provides a hand guard and/or a location to mount a sling (not shown) to the weapon 10.

As discussed above, the cover system 14 may include a composite material 42. The composite material 42 is selected as a material that will provide a predetermined amount of thermal insulation to heat emitted from the barrel 12. For example, the composite material 42 may provide a predetermined amount of thermal insulation relative to heat emitted from the exposed segment 36 of the barrel 12. In the exemplary embodiment, the base 44 of the cover system 14 is fabricated from the composite material 42, while the rails 46 are fabricated from a metal. In some alternative embodiments, the rails 46 are formed from the composite material 42 (in addition or alternatively to the base 44). In the exemplary embodiment, the composite material 42 of the base 44 thermally insulates the rails 46 from heat emitted from the barrel 12. The thermal insulative properties of the composite material 42 also thermally insulate the base 44 from heat emitted from the barrel 12.

The rails 46 may be fabricated from any materials, for example a metal as in the exemplary embodiment. When fabricated from a metal, the rails 46 may be fabricated from any metal, such as, but not limited to, aluminum, steel, and/or the like. Other materials that the rails 46 may be fabricated from include, but are not limited to, wood, a plastic, the composite material 42, another type of composite material, and/or the like. In some embodiments, the rails 46 are integrally formed with the base 44 from the same materials (e.g., the composite material 42) as the base 44. In other embodiments, for example as in the exemplary embodiment, the rails 46 are discrete components of the cover system 14 that are mounted to the base 44.

The predetermined amount of thermal insulation provided by the composite material 42 may provide a cooler gripping surface on the cover system 14 for a user to grasp the weapon 10. Accordingly, the thermal insulation provided by the composite material 42 may enable a user to grasp the weapon 10 without burning the user's hands, without experiencing discomfort, and/or without using gloves. The predetermined amount of thermal insulation provided by the composite material 42 may provide better repeatability for mounting components on the cover system 14. For example, the thermal insulative properties of the composite material 42 may facilitate reducing the amount that the base 44 and/or the rails 46 of the cover system 14 warp when subjected to heat emitted by the barrel 12. The mounting locations at which components are mounted to the cover system 14 may therefore experience less movement after a heat cycle (e.g., use) of the weapon 10, which may enable a component to be repeatedly mounted to, and dismounted from, the cover system 14 at substantially the same position relative to the remainder of the weapon 10. Moreover, the mounting locations at which components are mounted to the cover system 14 may therefore experience less movement during a heat cycle (e.g., use) of the weapon 10, which increase an accuracy of the weapon 10 by providing a more stable mounting location for a telescopic scope, a sight, a laser, a light, a range finder, a night vision scope, and/or the like. The composite material 42 of the cover system 14 may decrease a weight of the cover system 14, which may decrease an overall weight of the weapon 10 and/or may enable other locations, parts, structures, and/or components of the weapon 10 to be increased in number and/or weight.

Various parameters of the composite material 42 and/or other components of the weapon 10 may be selected to provide the composite material 42 with the predetermined amount of thermal insulation. For example, various parameters of the composite material 42 may be selected to provide the composite material 42 with a predetermined value of thermal conductivity k and/or with a predetermined R-value within the operational temperature range of the weapon 10. In some embodiments, the composite material 42 has a thermal conductivity k of less than approximately 1.00 watts per meter Kelvin (W/(m·K)), of less than approximately 0.50 W/(m·K), or of less than less than approximately 0.10 W/(m·K) within the operational temperature range of the weapon 10. The parameters of the composite material 42 and/or other components of the weapon 10 that may be selected to provide the composite material 42 with the predetermined amount of thermal insulation include, but are not limited to, the particular materials that constitute the composite material 42 (e.g., a particular matrix material, a particular reinforcement material, and/or the like), the particular type of composite material, a thickness of the composite material 42, the amount of radial spacing, if any, between the barrel 12 and the composite material 42, the materials used to fabricate the rails 46, an orientation and/or pattern of a reinforcement material of the composite material 42, a number and/or volume of fibers of a reinforcement material, and/or the like.

The particular type of the composite material 42 may be any type of composite material that enables the composite material 42 to provide the predetermined amount of thermal insulation. Examples of the particular type of the composite material 42 include, but are not limited to, a fiber-reinforced composite material, a fiber-reinforced polymer (FRP), a thermoplastic composite, a short fiber thermoplastic, a long fiber thermoplastic, a continuous fiber thermoplastic, a thermoset composite, a shape memory polymer composite, a metal matrix composite (MMC), a ceramic matrix composite, cermet, an organic matrix/ceramic aggregate composite, a wood plastic composite, an engineered wood, and/or the like. As described above, the particular type of the composite material 42 may be selected to provide the composite material 42 with the predetermined amount of thermal insulation.

The particular materials that constitute the composite material 42 may include any materials that enable the composite material 42 to provide the predetermined amount of thermal insulation. In some embodiments, the composite material 42 includes a reinforcement material and a matrix material. Examples of reinforcement materials of the composite material 42 include, but are not limited to, a short fiber reinforcement material, a long fiber reinforcement material, a continuous fiber reinforcement material, glass fibers, metal fibers, a metal powder, carbon fibers, aramid fibers, para-aramid fibers, meta-aramid fibers, a ceramic, and/or the like. The reinforcement materials may be arranged in any orientation and/or pattern, such as, but not limited to, a random pattern, a woven pattern, and/or the like. Examples of matrix materials of the composite material 42 include, but are not limited to, polyester, vinyl ester, epoxy, phenolic, polyimide, polyamide, polypropylene, polyether ether ketone (PEEK), a shape memory polymer, a ceramic, and/or the like. As described above, the particular materials that constitute the composite material 42 may be selected to provide the composite material 42 with the predetermined amount of thermal insulation.

In the exemplary embodiment, an interior surface 52 of the base 44 of the cover system 14 is radially spaced apart from the exterior circumference of the covered segment 38 of the barrel 12. The upper part 24 of the weapon 10 includes an optional thermal insulation member 54 that extends between the cover system 14 and the barrel 12. Specifically, the thermal insulation member 54 extends within the opening 32 of the cover system 14 radially between the interior surface 52 of the cover system 14 and the exterior circumference of the barrel 12 along at least a portion of the length of the cover system 14. The thermal insulation member 54 provides thermal insulation between the cover system 14 and the covered segment 38 of the barrel 12. The thermal insulation member 54 may be configured to provide any amount of thermal insulation between the barrel 12 and the cover system 14. The thermal insulation member 54 may be fabricated from any materials that enable the thermal insulation member 54 to provide thermal insulation between the cover system 14 and the barrel 12, such as, but not limited to, mineral wool, glass wool, a composite material (e.g., the composite material 42 or another type of composite material), an elastomeric foam, a rigid foam, plyethylene, aerogel, a spray foam, wood, extruded polystyrene foam, and/or the like.

In some alternative embodiments, an air gap extends between the interior surface 52 of the base 44 of the cover system 14 and the exterior circumference of the covered segment 38 of the barrel 12. Moreover, in some alternative embodiments, the interior surface 52 of the base 44 is engaged with the exterior circumference of the covered segment 38 and/or is engaged with one or more optional heat pipes 56 (described below with respect to FIG. 4).

Figure 3:
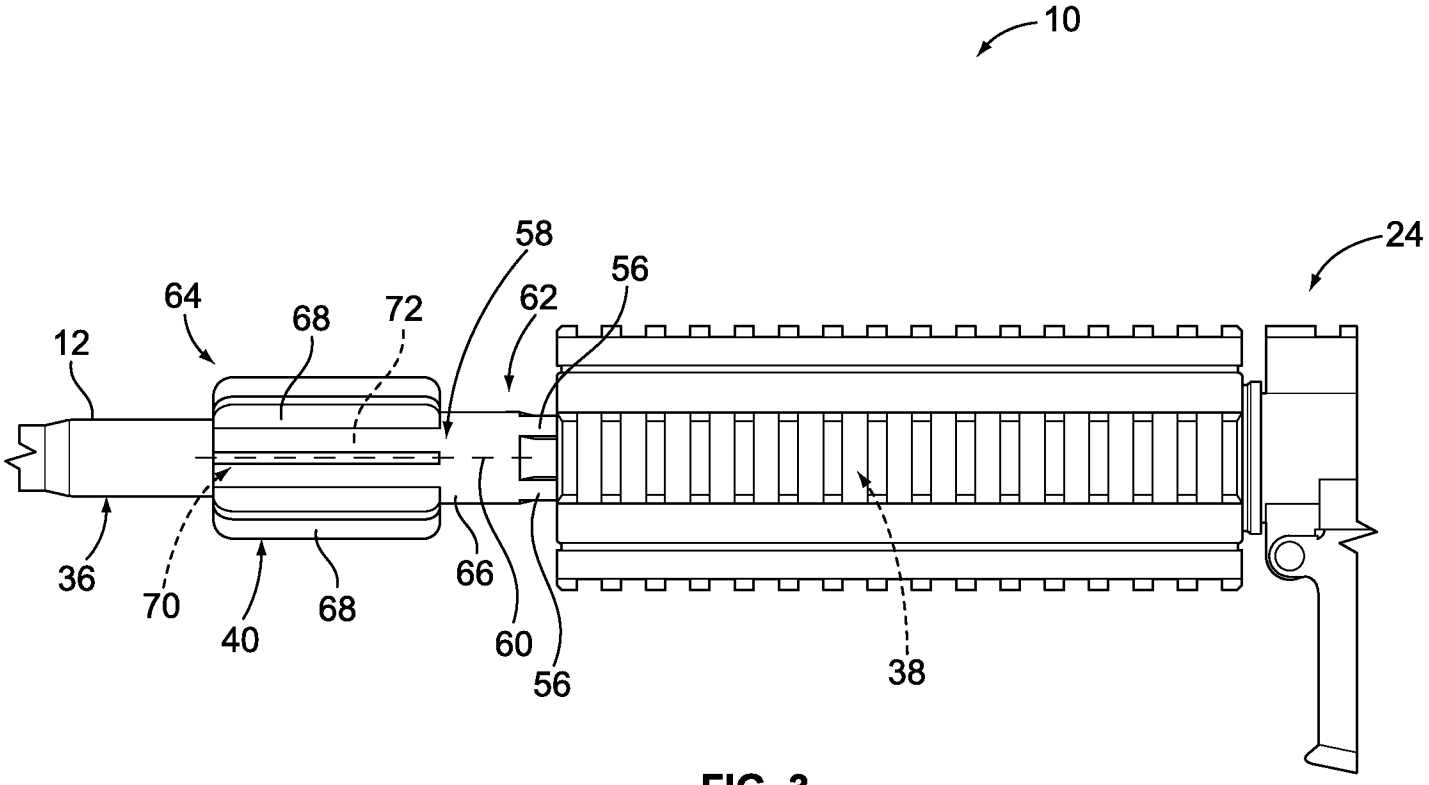
FIG. 3 is a side elevational view of a portion of the weapon shown in FIGS. 1 and 2.

FIG. 3 is a side elevational view of a portion of the weapon 10. Referring now to FIGS. 2 and 3, as briefly described above, the weapon 10 may include a heat sink 40. In the exemplary embodiment, the upper part 24 of the weapon 10 includes the heat sink 40. The heat sink 40 is mounted to the exposed segment 36 of the barrel 12 and is exposed to ambient air. The heat sink 40 may be mounted to the barrel 12 at any location along the length of the exposed segment 36.

The heat sink 40 is configured to dissipate heat from the barrel 12 to the ambient air. In the exemplary embodiment, the heat sink 40 includes a cylindrical body 58 that extends a length along a central longitudinal axis 60 (not shown in FIG. 2) from an end 62 to an opposite end 64. The body 58 includes a collar 66 and one or more fins 68 that extend radially (relative to the central longitudinal axis 60) outwardly from the collar 66. The fins 68 are configured to dissipate heat to the ambient air. The collar 66 includes a central opening 70 that extends along the central longitudinal axis 60 through the length of the collar 66. A radially (relative to the central longitudinal axis 60) interior surface 72 of the collar 66 defines the central opening 70. The heat sink 40 may include any number of the fins 68, which may be arranged in any other pattern and/or configuration than is shown. In addition or alternative to the fins 68, the heat sink 40 may include any other structure that facilitates dissipating heat to the ambient air (e.g., any structure that increases the surface area of the heat sink 40.

The heat sink 40 is mounted to the exposed segment 36 of the barrel 12 such that the exposed segment 36 extends through the central opening 70. The collar 66 extends around at least a portion of the exterior circumference of the exposed segment 36 of the barrel 12. In the exemplary embodiment, the collar 66 forms a simple closed curve such that the collar 66 extends around an approximate entirety of the exterior circumference of the exposed segment 36. But, the collar 66 may alternatively form an open curve such that the collar 66 extends around only a portion of the exterior circumference of the exposed segment 36.

When mounted to the exposed segment 36 of the barrel 12 as shown and described herein, the interior surface 72 of the collar 66 is engaged with the exterior circumference of the exposed segment 36. The body 58 of the heat sink 40 absorbs heat from the exposed segment 36 of the barrel 12 via the engagement between the body 58 and the exposed segment 36. The body 58 of the heat sink 40 dissipates the heat absorbed from exposed segment 36 to the ambient air via the exterior surface area of the body 58. For example, heat is dissipated to the ambient air via the exterior surface area of the fins 68. Moreover, and as will be described below, the heat pipes 56 may be used to enable the body 58 of the heat sink 40 to dissipate heat from the covered segment 38 of the barrel 12 to the ambient air.

Various parameters of the heat sink 40 may be selected such that the heat sink 40 is configured to dissipate a predetermined amount of heat from the barrel 12 and/or is configured to dissipate heat from the barrel 12 at a predetermined rate. For example, various parameters of the heat sink 40 may be selected to provide the heat sink 40 with a predetermined thermal conductivity k within the operational temperature range of the weapon 10. In some embodiments, the heat sink 40 has a thermal conductivity k of greater than approximately 100 W/(m·K), of greater than approximately 200 W/(m·K), or of greater than approximately 350 W/(m·K) within the operational temperature range of the weapon 10. Examples of the various parameters of the heat sink 40 that may be selected include, but are not limited to, the materials used to fabricate the heat sink 40, the size of the heat sink 40, the exterior surface area of the heat sink 40, the shape of the heat sink 40, the structure and/or configuration of the heat sink 40, the location of the heat sink 40 along the length of the barrel 12, and/or the like. Still further examples of the various parameters of the heat sink 40 that may be selected include, but are not limited to, the number of fins 68, the size of each of the fins 68, the shape of each of the fins 68, the spacing between adjacent fins 68, the exterior surface area of each of the fins 68, the pattern and/or configuration of the fins 68, and/or the like. Examples of materials used to fabricate the heat sink 40 include, but are not limited to, aluminum, an aluminum alloy, copper, a copper allow, diamond, and/or the like.

Figure 4:
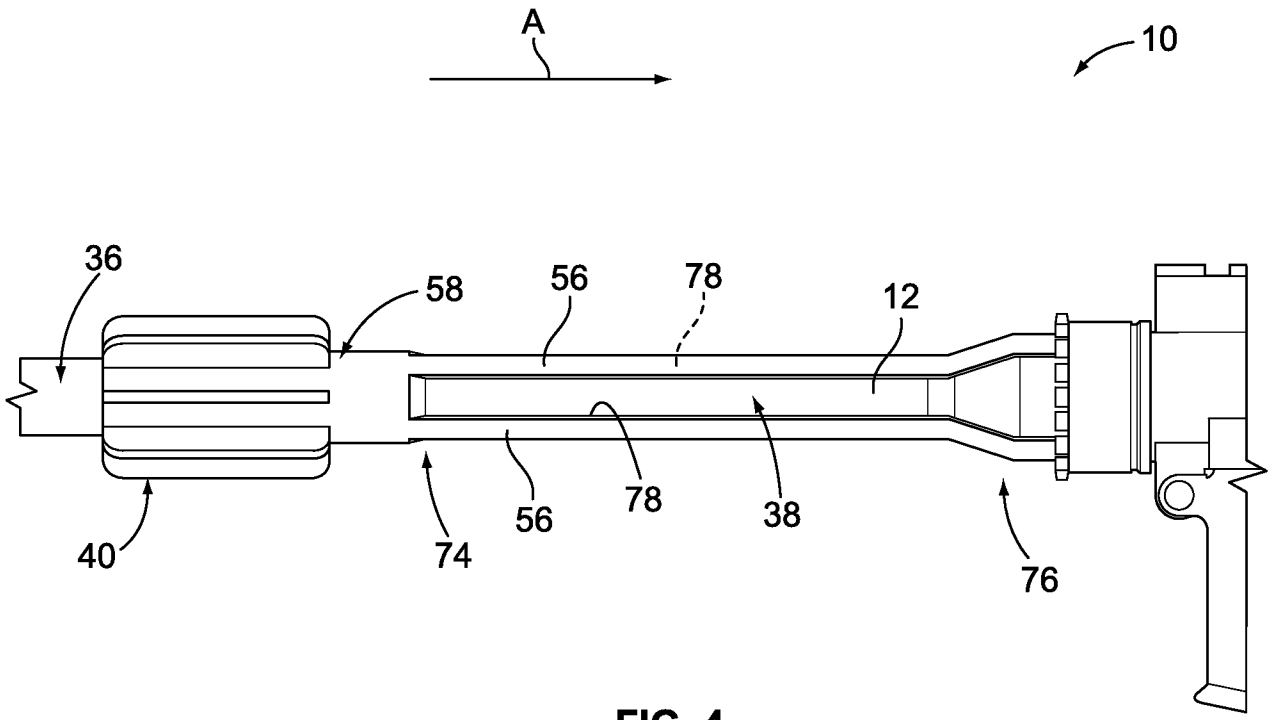
FIG. 4 is another side elevational view of a portion of the weapon shown in FIGS. 1-3 illustrating the weapon with an exemplary embodiment of a cover system removed the weapon.

FIG. 4 is another side elevational view of a portion of the weapon 10. The cover system 14 (FIGS. 1-3) has been removed from the weapon 10 in FIG. 4 to illustrate the heat pipes 56 and the covered segment 38 of the barrel 12. As briefly described above, the heat pipes 56 may be used to enable the body 58 of the heat sink 40 to dissipate heat from the covered segment 38 of the barrel 12 to the ambient air. Specifically, the heat pipes 56 are configured to direct heat from the covered segment 38 of the barrel 12 to the heat sink 40. As the heat sink 40 is mounted to the exposed segment 36 of the barrel, the heat pipes 56 direct heat to the heat sink 40 from one or more locations along the length of the barrel 12 that are spaced apart from the heat sink 40 (e.g., one or more locations along the covered segment 38).

The heat pipes 56 are mounted to the barrel 12 such that each heat pipe 56 extends a length outwardly from the heat sink 40, and along the length of the barrel 12, in a direction toward the butt stock 22 (FIG. 1), which is indicated by the arrow A in FIG. 4. The lengths of the heat pipes 56 extend from ends 74 of the heat pipes 56 to opposite ends 76 of the heat pipes 56. The ends 74 of the heat pipes 56 are in thermal communication with the heat sink 40 such that the heat pipes 56 thermally communicate with the heat sink 40. The heat pipes 56 extend along at least a portion of the length of the covered segment 38 of the barrel 12. In the exemplary embodiment, the heat pipes 56 extend along a majority of the length of the covered segment 38. But, each heat pipe 56 may extend along any amount and/or portion of the length of the covered segment 38. In some embodiments, one or more heat pipes 56 extends along a different amount and/or portion of the length of the covered segment 38 than one or more other heat pipes 56.

Figure 5:
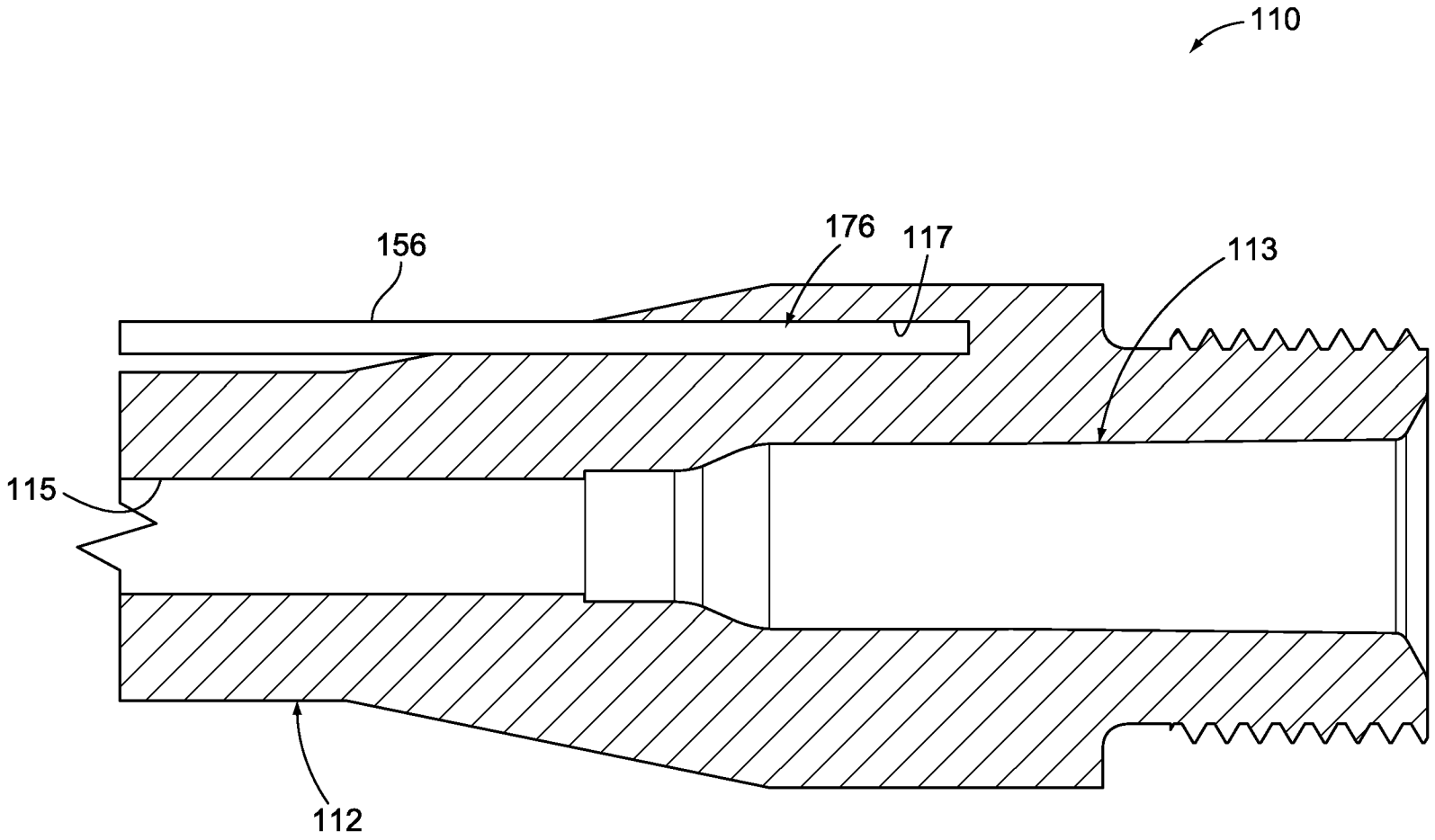
FIG. 5 is a cross-sectional view of another exemplary embodiment of a weapon.

The hottest areas of the barrel 12 may be the chamber 13 (FIG. 1), segments of the barrel 12 that are proximate the chamber 13, and the gas tube area. The ends 76 of the heat pipes 56 may be positioned as close to the chamber 13 without affecting the structural integrity during pressure loading. In some embodiments, the heat pipes 56 extend along the barrel 12 such that the ends 76 are positioned along the chamber 13 and/or the gas tube area. For example, FIG. 5 is a cross-sectional view of another exemplary embodiment of a weapon 110. The weapon 110 includes a barrel 112, a chamber 113, and one or more heat pipes 156. Although only one is shown in FIG. 5, the weapon 110 may include any number of the heat pipes 156. The barrel 112 includes a central bore 115 and a cavity 117. The cavity 117 extends along at least a portion of the length of the chamber 112 and is spaced radially apart from the central bore 115. The heat pipe 156 includes an end 176 that is received within the cavity 115 such that the end 176 extends along at least a portion of the length of the chamber 113.

Referring again to FIG. 4, the heat pipes 56 include interior surfaces 78 that are engaged with the exterior circumference of the covered segment 38. The heat pipes 56 absorb heat from the covered segment 38 of the barrel 12 via the engagement between the heat pipes 56 and the covered segment 38. The heat pipes 56 direct the heat absorbed from the covered segment 38 to the heat sink 40 via the thermal communication between the heat pipes 56 and the heat sink 40. In some embodiments, the heat pipes 56 direct heat from the chamber 13, the gas tube area, and/or segments of the barrel 12 that are proximate the chamber 13 to the heat sink 40. The body 58 of the heat sink 40 dissipates the heat absorbed from the heat pipes 56 to the ambient air via the exterior surface area of the body 58. The heat sink 40 thus dissipates heat from the covered segment 38 of the barrel 12 to the ambient air.

Various parameters of each of the heat pipes 56 may be selected such that the heat pipes 56 are configured to direct a predetermined amount of heat from the covered segment 38 to the heat sink 40 and/or are configured to direct heat from the covered segment 38 to the heat sink 40 at a predetermined rate. For example, various parameters of the heat pipes 56 may be selected to provide the heat pipes 56 with a predetermined thermal conductivity k within the operational temperature range of the weapon 10. In some embodiments, the heat pipes 56 have a thermal conductivity k of greater than approximately 100 W/(m·K), of greater than approximately 200 W/(m·K), or of greater than approximately 350 W/(m·K) within the operational temperature range of the weapon 10.

Examples of the various parameters of each of the heat pipes 56 that may be selected include, but are not limited to, the materials used to fabricate the heat pipes 56, the type of heat pipe, the size (e.g., thickness, width, length, and/or the like) of the heat pipes 56, the shape of the heat pipes 56, the number of the heat pipes 56, the amount of the length of the covered segment 38 along which the heat pipes 56 extend, the surface area of engagement between the heat pipes 56 and the covered segment 38, the structure and/or configuration of the heat pipes 56, the orientation of the heat pipes 56, and/or the like. In some embodiments, the orientation of the heat pipes 56 may be selected such that the heat pipes 56 angle upwardly toward the heat sink 40 when the weapon 10 is held approximately level such that any liquid that turns to steam (e.g., from exposure to heat from the covered segment 38 of the barrel 12) within the heat pipes 56 will flow upwardly toward the heat sink 40 when the weapon 10 is held approximately level. Moreover, in some embodiments, the orientation of the heat pipes 56 may be selected such that the heat pipes 56 angle downwardly toward the heat sink 40 when the weapon 10 is held approximately level such that any liquid within the heat pipes 56 will flow downwardly toward the heat sink 40 when the weapon 10 is held approximately level. Examples of types of heat pipes 56 include, but are not limited to, fluid filled heat pipes, vacuum heat pipes, solid heat pipes, and/or the like. Examples of materials used to fabricate the heat sink 40 include, but are not limited to, aluminum, an aluminum alloy, copper, a copper alloy, diamond, and/or the like. The weapon 10 may include any number of the heat pipes 56.

In the exemplary embodiment, the heat pipes 56 are integrally formed with the heat sink 40. Alternatively, one or more of the heat pipes 56 is a discrete component from the heat sink 40 that is separately formed relative to the heat sink 40 and thereafter configured in thermal communication with the heat sink 40. A heat pipe 56 that is a discrete component from the heat sink 40 may be configured in thermal communication with the heat sink 40 via engagement with the heat sink 40, whether or not the heat pipe 56 is otherwise connected or secured to the heat sink 40.

The heat sink 40 facilitates faster cooling of the weapon 10 during and after use. The heat sink 40 may facilitate increasing the accuracy of the weapon 10 by reducing or preventing warping of the weapon 10 during use. The heat sink 40 may facilitate increasing the accuracy of the weapon 10 by reducing or preventing non-uniform expansion and/or contraction of different portions of the barrel 12 and/or other portions of the weapon 10 caused by dissimilar heating. Moreover, the heat sink 40 may facilitate preventing a chambered round from firing, or cooking off, without the trigger of the weapon 10 being engaged.

The heat pipes 56 facilitate spreading heat out over the length of the barrel 12 and/or over the length of the weapon 10 in general. Moreover, the heat pipes 56 direct heat from a location along the weapon 10 that is less suitable for heat transfer (e.g., the cover system 14) to a location along the weapon 10 that is more suitable for heat transfer (e.g., the exposed segment 36 of the barrel 12). In other words, the heat pipes 56 direct heat to a location along the weapon 10 where heat can be dissipated at a greater rate and/or where a greater amount of heat can be dissipated. The heat pipes 56 may thus facilitate faster cooling of the weapon 10. The heat pipes 56 may direct heat from a location along the weapon 10 wherein a user handles, or grasps, the weapon 10 (e.g., the cover system 14) to a location where the weapon 10 may not be handled (e.g., the exposed segment 36 of the barrel 12).

In some alternative embodiments, the weapon 10 does not include the cover system 14 and the heat sink 40 and heat pipes 56 are used to cool the weapon 10, to facilitate spreading heat out over the length of the barrel 12 and/or over the length of the weapon 10 in general, and/or direct heat from a location along the weapon 10 that is less suitable for heat transfer to a location along the weapon 10 that is more suitable for heat transfer.

Figure 6:
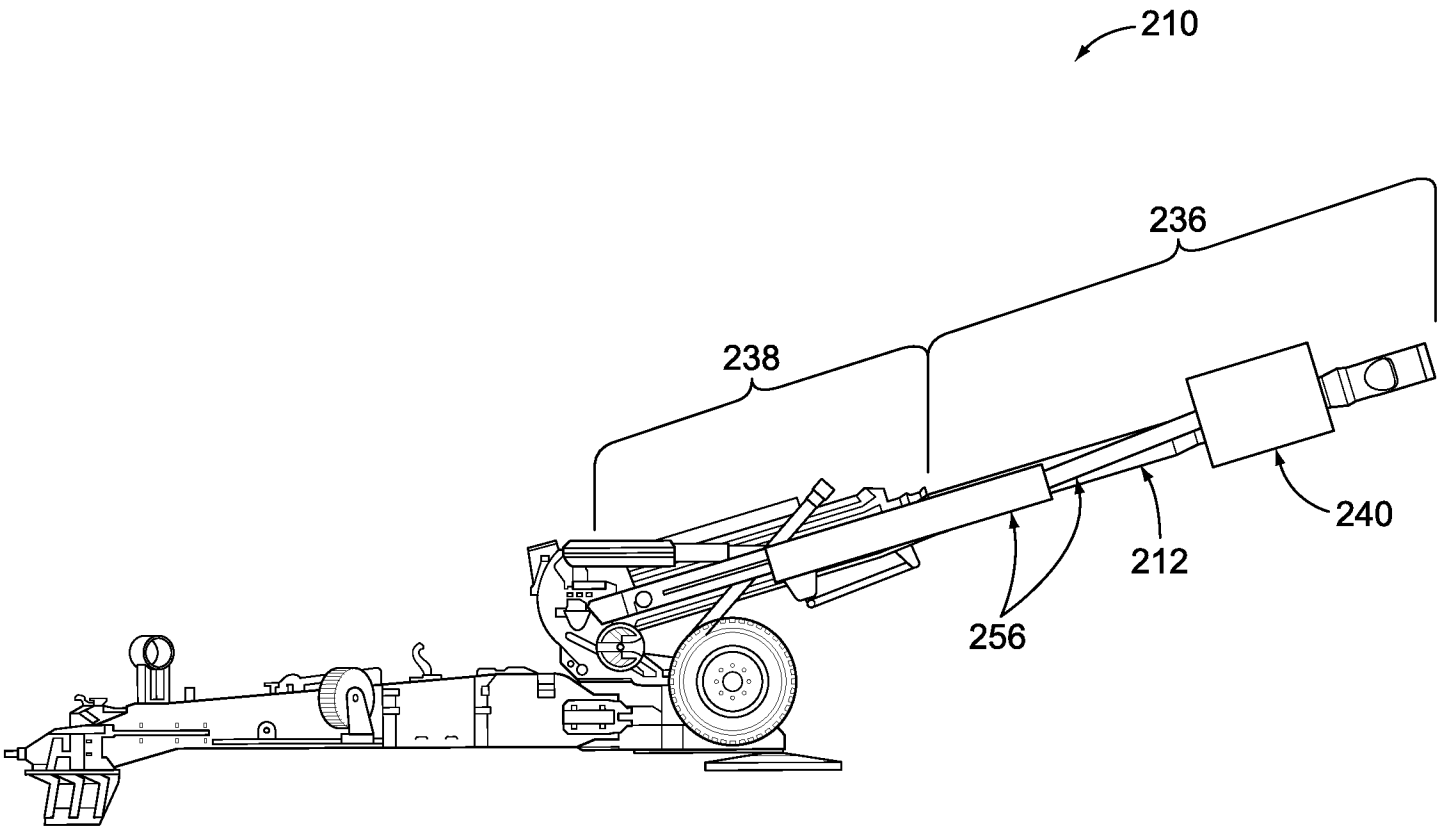
FIG. 6 is a side elevational view of another exemplary embodiment of a weapon.

FIG. 6 is a side elevational view of another exemplary embodiment of a weapon 210. In the exemplary embodiment, the weapon 210 is an artillery piece. The weapon 210 includes a barrel 212 that extends a length. The length of the barrel 212 includes an exposed segment 236 and a covered segment 238. At least a portion of the length of the exposed segment 236 is exposed to ambient air. In the exemplary embodiment, a portion of the length of the exposed segment 236 is covered by a heat sink 240 that is mounted to the exposed segment 236, such that only a portion of the length of the exposed segment 236 is exposed to ambient air.

The heat sink 240 absorbs heat from the exposed segment 236 of the barrel 212 and dissipates the heat absorbed from exposed segment 236 to the ambient air. One or more heat pipes 256 may be used to enable the heat sink 240 to dissipate heat from the covered segment 238 of the barrel 212 to the ambient air. The heat pipes 256 direct heat to the heat sink 240 from one or more locations along the length of the barrel 212 that are spaced apart from the heat sink 240. For example, in the exemplary embodiment, the heat pipes 256 are configured to direct heat from the covered segment 238 of the barrel 212 to the heat sink 240. Optionally, one or more components of the weapon 210 includes a composite material (not shown) that is configured to provide thermal insulation relative to heat emitted from the barrel 212.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A weapon comprising:

a cover system extending a length to an end of the cover system;

a barrel comprising an exposed segment that extends outwardly from the end of the cover system and is exposed to ambient air; and a heat sink mounted to the exposed segment of the barrel, the heat sink being configured to dissipate heat from the barrel to the ambient air; and a heat pipe being mounted to the barrel such that the heat pipe thermally communicates with the heat sink, the heat pipe being configured to direct heat to the heat sink from a location along the barrel that is spaced apart from the heat sink.

2. The weapon of claim 1, wherein the heat pipe comprises at least one of copper, a fluid filled heat pipe, or a vacuum heat pipe.

3. The weapon of claim 1, wherein the heat sink comprises at least one fin that is configured to dissipate heat to the ambient air.

4. The weapon of claim 1, wherein the exposed segment of the barrel has an exterior circumference, the heat sink comprising a collar that extends around at least a portion of the exterior circumference of the exposed segment of the barrel.

5. The weapon of claim 1, wherein the heat sink comprises a cylindrical body having a central opening extending therethrough, the exposed segment of the barrel extending through the central opening of the cylindrical body of the heat sink.

6. The weapon of claim 1, wherein the barrel includes a covered segment that is at least partially surrounded by the cover system, the heat pipe being configured to direct heat from the covered segment of the barrel to the heat sink.

7. The weapon of claim 1, wherein the barrel includes a covered segment that is at least partially surrounded by the cover system, the heat pipe extending along at least a portion of a length of the covered segment of the barrel.

8. The weapon of claim 1, wherein the heat pipe is oriented such that heat pipe angles one of downwardly or upwardly toward the heat sink when the weapon is held approximately level.

* * * * *